US010016882B1

(12) United States Patent
Lai

(10) Patent No.: US 10,016,882 B1
(45) Date of Patent: Jul. 10, 2018

(54) PLIERS FOR A HOSE CLAMP

(71) Applicant: Chiu-Chi Lai, Taichung (TW)

(72) Inventor: Chiu-Chi Lai, Taichung (TW)

( * ) Notice: Subject to any disclaimer, the term of this patent is extended or adjusted under 35 U.S.C. 154(b) by 0 days.

(21) Appl. No.: 15/456,877

(22) Filed: Mar. 13, 2017

(51) Int. Cl.
*B25B 25/00* (2006.01)
*B25B 27/10* (2006.01)
*B25B 7/02* (2006.01)

(52) U.S. Cl.
CPC ..... *B25B 25/005* (2013.01); *B25B 27/10* (2013.01); *B25B 7/02* (2013.01)

(58) Field of Classification Search
CPC ..... B25B 25/005; B25B 7/02; B25B 7/12; B25B 27/10; B25B 7/18
See application file for complete search history.

(56) References Cited

U.S. PATENT DOCUMENTS 788,300 A * 4/1905 Wilson ..... B25B 7/10 81/328
979,348 A * 12/1910 Smith ..... B25B 13/12 81/129
1,344,154 A * 6/1920 Shoopman ..... B25B 13/22 81/131
1,428,546 A * 9/1922 Johnston ..... B25B 13/12 81/142
1,481,186 A * 1/1924 Busch ..... B25B 13/22 7/143
2,000,962 A * 5/1935 Krag ..... B67B 7/18 7/139
2,447,685 A * 8/1948 Chester ..... B25B 1/103 269/142
3,625,096 A * 12/1971 Myers ..... B25B 13/22 81/10
5,823,076 A * 10/1998 Binkowski ..... B25B 13/22 81/127
6,257,100 B1 * 7/2001 Tai ..... B25B 13/12 7/139
8,925,426 B2 * 1/2015 Shishkin ..... B25B 13/18 81/129
9,242,352 B2 * 1/2016 Arbel ..... B25B 13/12

FOREIGN PATENT DOCUMENTS

TW M307500 U 3/2007

* cited by examiner

*Primary Examiner* — Monica Carter
*Assistant Examiner* — Danny Hong
(74) *Attorney, Agent, or Firm* — Muncy, Geissler, Olds & Lowe, P.C.

(57) ABSTRACT

A pliers for a hose clamp is provided, including a pivoting assembly and a clamping assembly. The pivoting assembly includes a first shank portion and a second shank portion which are pivotally assembled with each other. The clamping assembly includes a first clamping portion and a second clamping portion, the first clamping portion and the second clamping portion are connected to the pivoting assembly, and the first clamping portion is actuatable by the first shank portion to change relative positions of the first clamping portion and the second clamping portion.

8 Claims, 7 Drawing Sheets

PLIERS FOR A HOSE CLAMP

BACKGROUND OF THE INVENTION

Field of the Invention

The present invention relates to a hand tool, and more particularly to a pliers for a hose clamp.

Description of the Prior Art

Conventionally, a common elastic hose clamp is disassembled by clamping two ends of the hose clamp tightly so that a radial dimension of the hose clamp increases and can be disassembled. However, this type of tool has a complex structure and is not easy to be assembled or stored. Therefore, for the convenience of usage and storage, a conventional hose clamp generally have two clamping portions and two gripping portions which are connected with each other to form a shape of a pliers so that a user can grip the grip portions and clamp the two ends of the hose clamp. This type of hose clamp disassembling tool is disclosed in TWM307500.

However, a distance between the two clamping portions of this type of hose clamp clip disassembling tool cannot be adjusted in advance, so when the user wants to clamp the two ends of the hose clamp, s/he has to reopen the two clamping portions to a width matching a width of the hose clamp so as to disassemble the hose clamp. Therefore, when the user wants to disassemble a great number of hose clamps, s/he needs to close and open the two clamping portions many times, and it is time-wasting and energy-consuming.

The present invention has arisen to mitigate and/or obviate the afore-described disadvantages.

SUMMARY OF THE INVENTION

The major object of the present invention is to provide a pliers for a hose clamp, a distance between two clamping portions can be adjusted in advance so that a user need not open and close the two clamping portions in a great scale so as to alleviate the burden to the user's hands and effectively increase the working efficiency. In addition, the pliers for the hose clamp has a simple structure and is easy to use.

To achieve the above and other objects, a pliers for a hose clamp is proviced, including a pivoting assembly, a displacement assembly, an adjustment assembly and a clamping assembly. The pivoting assembly includes a first shank portion and a second shank portion which are pivotally assembled with each other. The displacement assembly is assembled to the pivoting assembly and includes a connecting member and a slidable member, the slidable member is slidable along a linear direction, and the connecting member is pivotally disposed between the first shank portion and the slidable member. The adjustment assembly is assembled to the pivoting assembly and includes an abutting member and an adjusting member, the abutting member positioningly abuts against and toward the adjusting member normally, and when the abutting member non-abuts against the adjusting member, the adjusting member is slidable parallel to the linear direction freely. The clamping assembly includes a first clamping portion and a second clamping portion, the first clamping portion is co-movably disposed on the slidable member, the second clamping portion is disposed on the adjusting member, the second clamping portion is located by one of two sides of the first clamping portion on the linear direction, and the first clamping portion is located between the second clamping portion and the connecting member. When the first shank portion and the second shank portion swing toward each other, the connecting member is driven by the first shank portion to push the slidable member to move toward the second clamping portion, and the first clamping portion and the second clamping portion move toward each other; when the first shank portion and the second shank portion swing away from each other, the connecting member is driven by the first shank portion to pull the slidable member to move away from the second clamping portion, and the first clamping portion and second clamping portion move away from each other.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
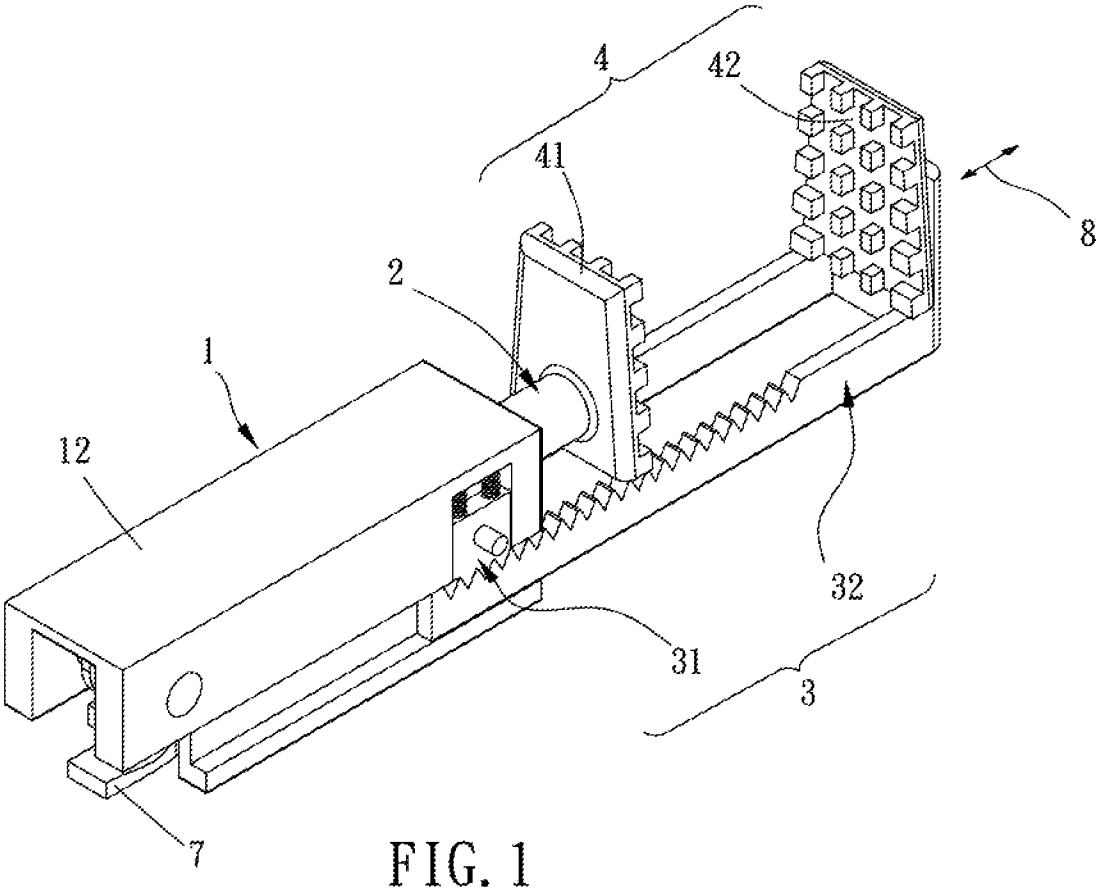
FIG. 1 is a stereogram of a first preferred embodiment of the present invention.
Figure 2:
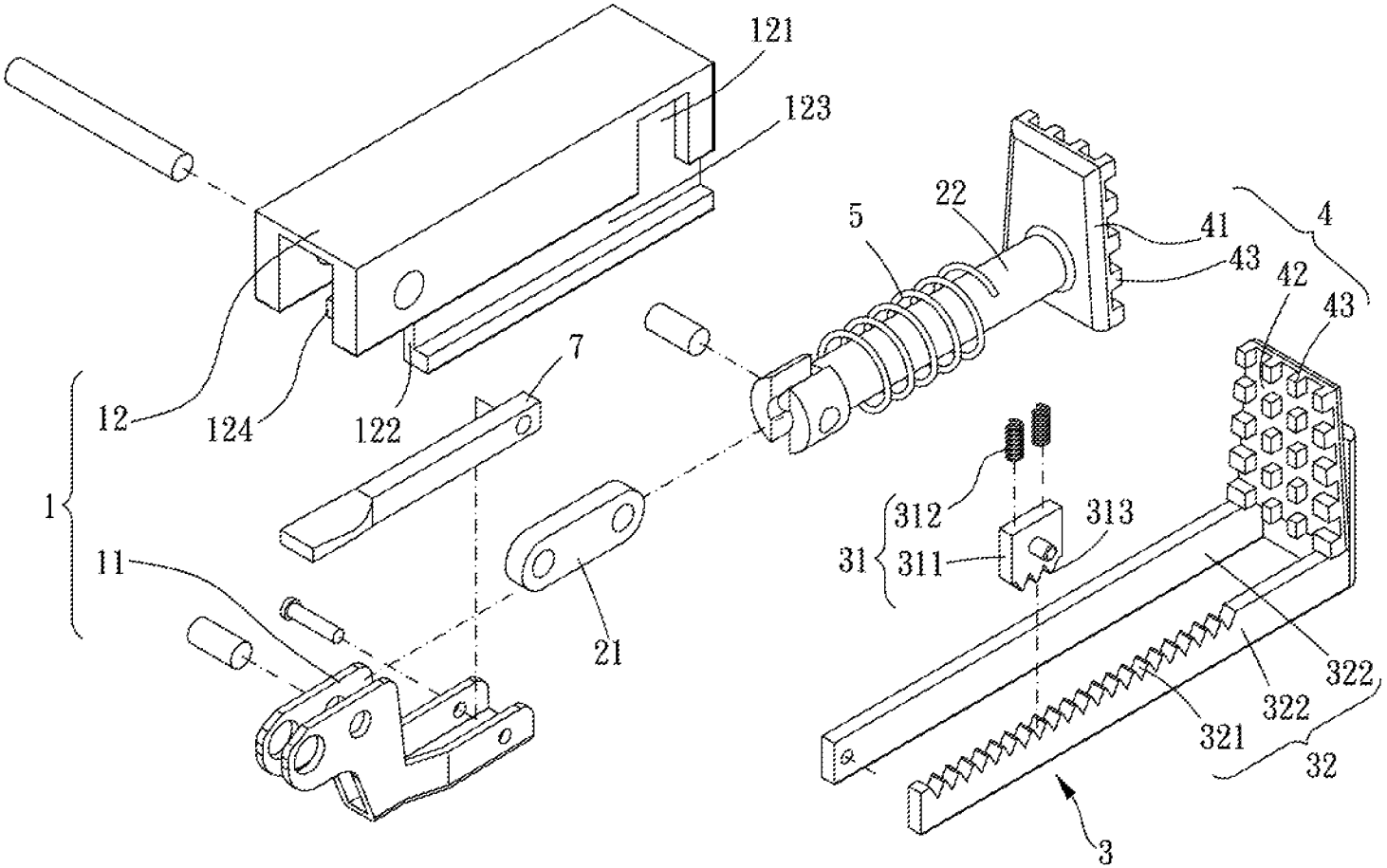
FIG. 2 is a breakdown view of the first preferred embodiment of the present invention.
Figure 3:
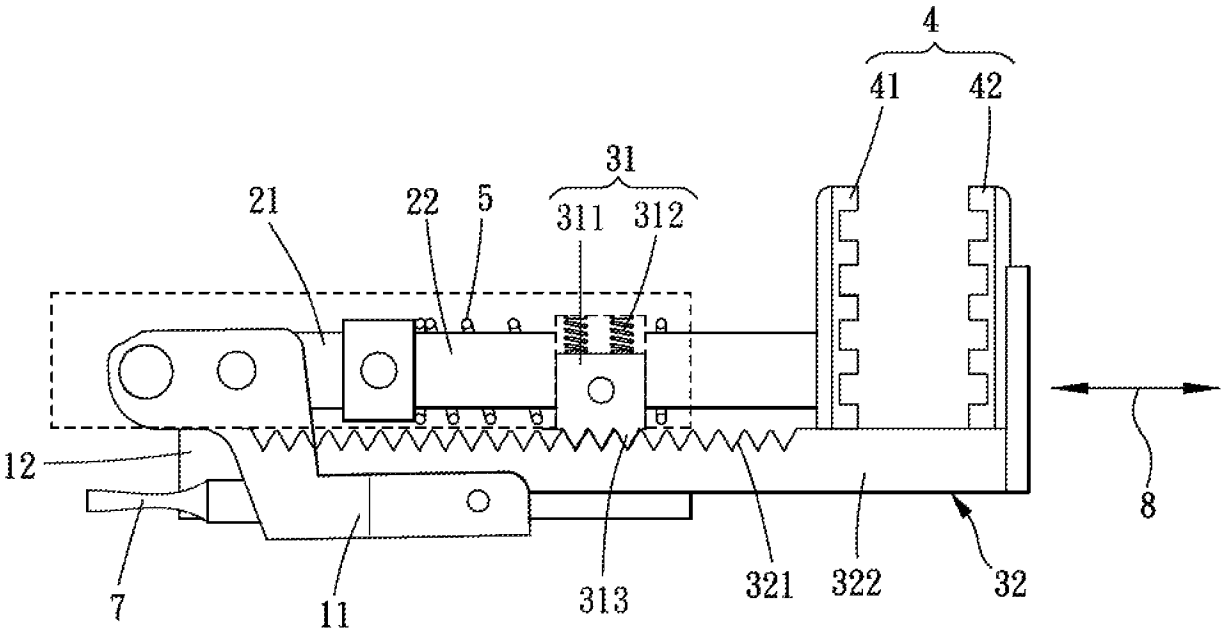
FIGS. 3 and 4 are side views of the first preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 7 for a preferred embodiment of the present invention. A pliers for a hose clamp includes a pivoting assembly 1, a displacement assembly 2, an adjusting assembly 3 and a clamping assembly 4.

The pivoting assembly 1 includes a first shank portion 11 and a second shank portion 12 which are pivotally assembled with each other.

The displacement assembly 2 is assembled to the pivoting assembly 1 and includes a connecting member 21 and a slidable member 22, the slidable member 22 is slidable along a linear direction 8, and the connecting member 21 is pivotally disposed between the first shank portion 11 and the slidable member 22.

The adjustment assembly 3 is assembled to the pivoting assembly 1 and includes an abutting member 31 and an adjusting member 32, the abutting member 31 positioningly abuts against and toward the adjusting member 32 normally, and when the abutting member 31 non-abuts against the adjusting member 32, the adjusting member 32 is slidable parallel to the linear direction 8 freely.

The clamping assembly 4 includes a first clamping portion 41 and a second clamping portion 42, the first clamping portion 41 is co-movably disposed on the slidable member 22, the second clamping portion 42 is disposed on the adjusting member 32, the second clamping portion 42 is located by one of two sides of the first clamping portion 41 on the linear direction 8, and the first clamping portion 41 is located between the second clamping portion 42 and the connecting member 21.

Figure 5:
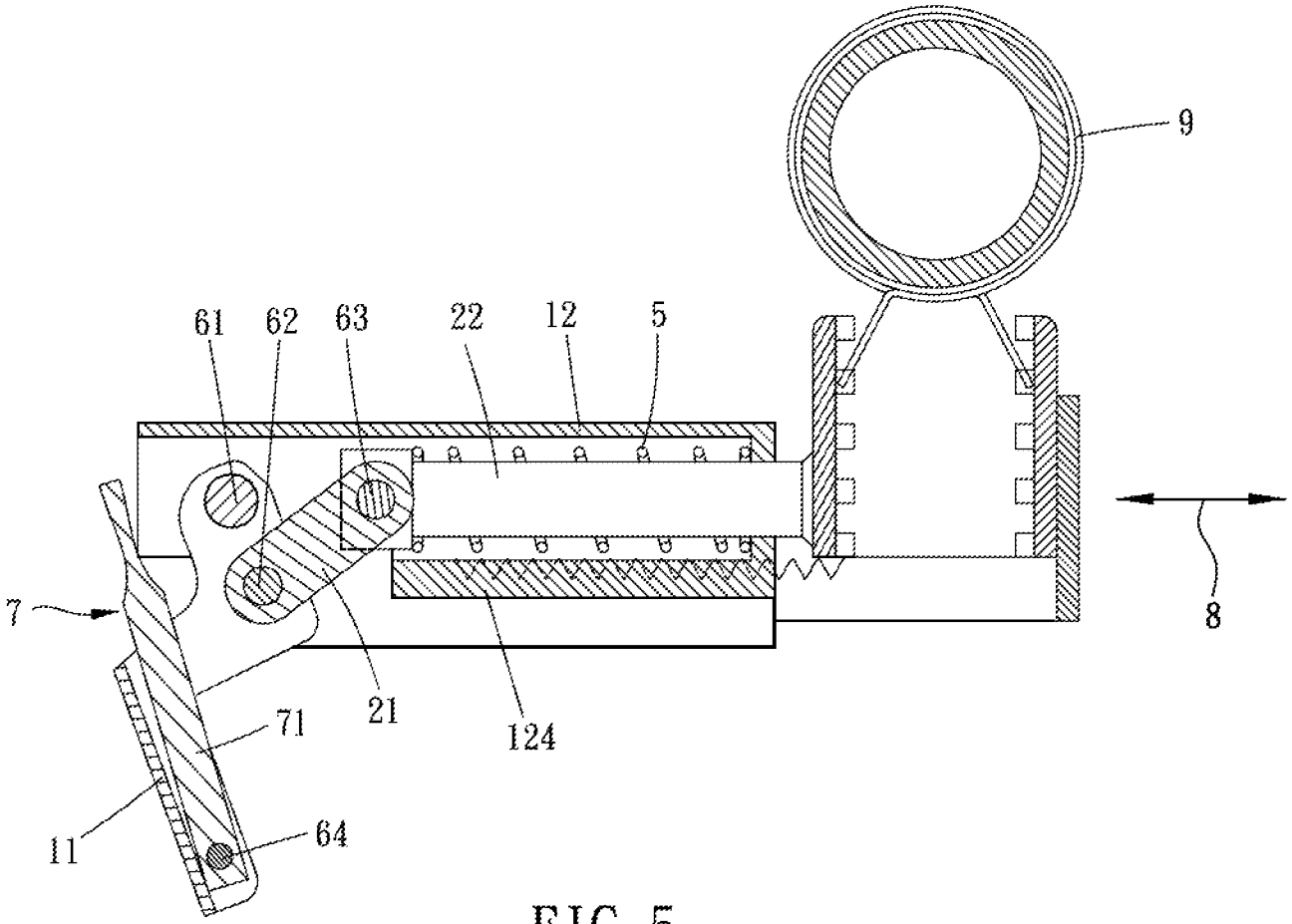
FIGS. 5 and 6 are drawings showing the first preferred embodiment of the present invention in operation.
Figure 6:
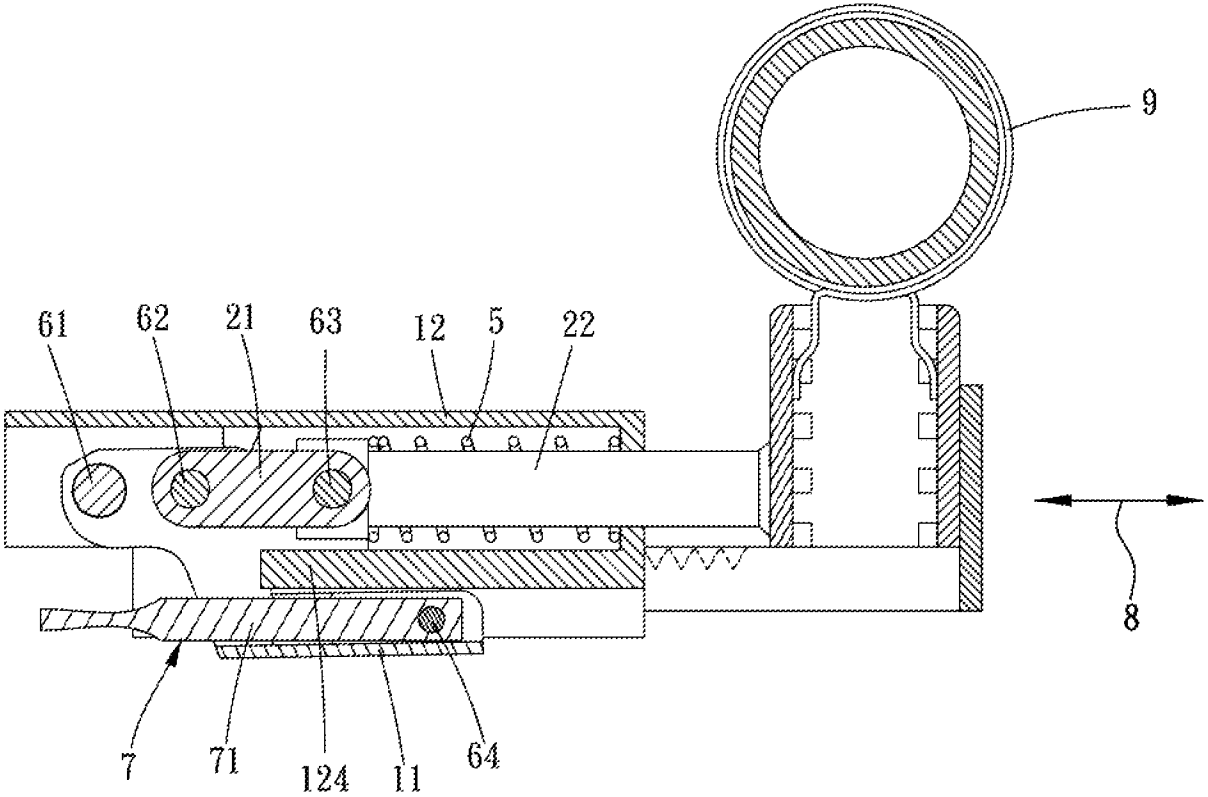

When the first shank portion 11 and the second shank portion 12 swing toward each other, the connecting member 21 is driven by the first shank portion 11 to push the slidable member 22 to move toward the second clamping portion 42, and the first clamping portion 41 and the second clamping portion 42 move toward each other (as shown in FIG. 6); when the first shank portion 11 and the second shank portion 12 swing away from each other, the connecting member 21 is driven by the first shank portion 11 to pull the slidable member 22 to move away from the second clamping portion 42, and the first clamping portion 41 and second clamping portion 42 move away from each other (as shown in FIG. 5).

Preferably, the pliers for the hose clamp further includes a first elastic member 5, the second shank portion 12 is a U-shaped board member, the first elastic member 5 abuts against and between the second shank portion 12 and the slidable member 22 so that the slidable member 22 normally moves away from the second clamping portion 42.

In addition, preferably, one of the two sides of the first clamping portion 41 and one of two sides of the second clamping portion 42 which face each other respectively have a plurality of protrusive blocks 43 which are arranged spacingly, and the protrusive blocks 43 are for abutting against two ends of a hose clamp 9 which is clamped by the first and second clamping portions 41, 42. More specifically, a space between two of the protrusive blocks 43 neighboring each other is for an end of the hose clamp to protrude therein to laterally abut against each said protrusive blocks 43 so as to make sure that the two ends of the hose clamp 9 will not loose off easily during a clamping process.

Figure 4:
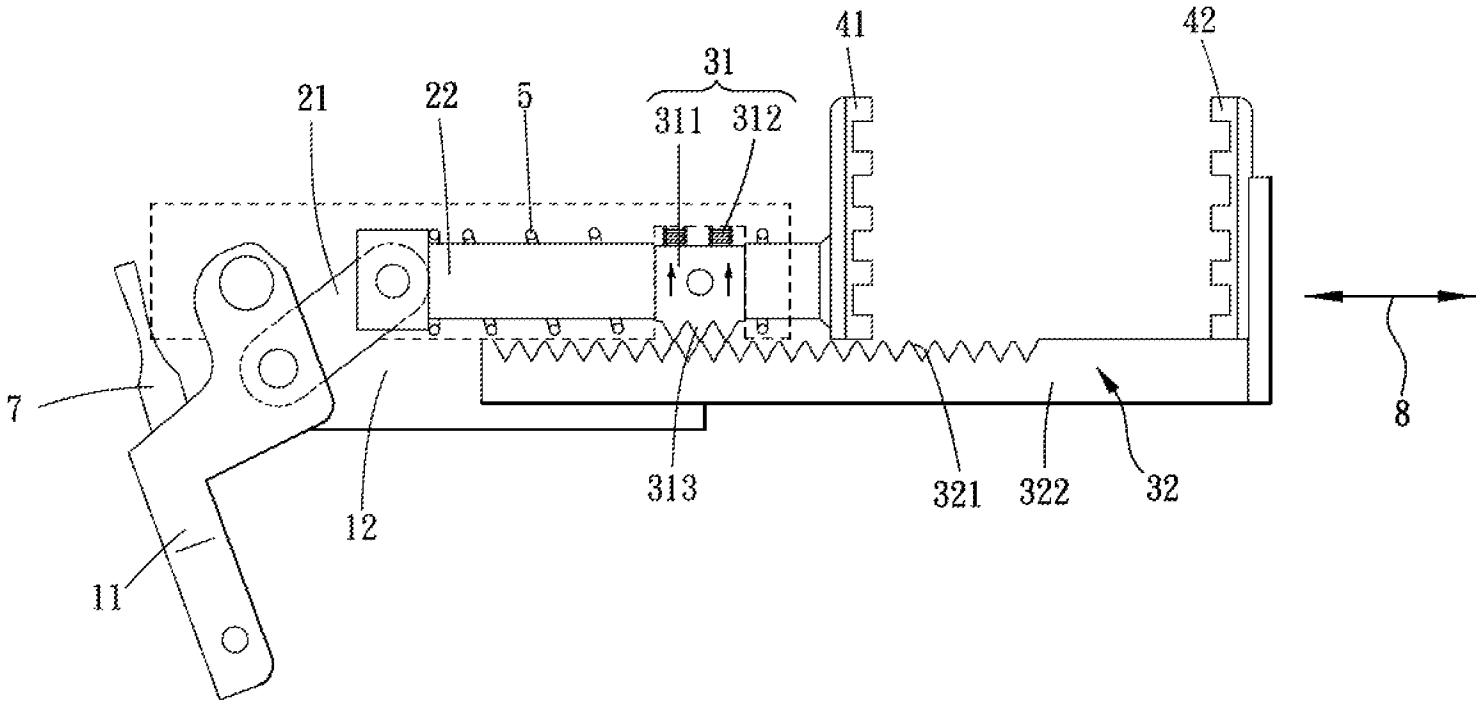

Furthermore, the abutting member 31 includes an abutting block 311 and at least one second elastic member 312, in this embodiment, there are two said second elastic members 312, the adjusting member 32 is slidably arranged within the second shank portion 12, the second shank portion 12 has a receiving groove 121, the abutting block 311 and the at least one second elastic member 312 are received in the receiving groove 121, the at least one second elastic member 312 abuts against and between a wall of the receiving groove 121 and the abutting block 311 so as to abut the abutting block 311 normally toward the adjusting member 32, the abutting block 311 has a first toothed portion 313, the adjusting member 32 has a second toothed portion 321 which abuts against the first toothed portion 313, and when the first toothed portion 313 abuts against the second toothed portion 321, the adjusting member 32 is unable to slide relative to the second shank portion 12. In this embodiment, the adjusting member 32 further includes two arm portions 322, the second clamping portion 42 is connected to the two arm portions 322, two sides of the second shank portion 12 have two L-shaped extension sections 122, the two L-shaped extension sections 122 include two sliding grooves 123 which are parallel to the linear direction 8, and the two arm portions 322 are respectively slidably arranged in the two sliding grooves 123. When the user wants to adjust an initial distance (the distance before swinging between the first shank portion 11 and the second shank portion 12) between the first clamping portion 41 and the second clamping portion 42, s/he only needs to toggle the abutting block 311 away from the two arm portions 322 to make the first toothed portion 313 non-abut against the second toothed portion 321 (as shown in FIG. 4), then the two arm portions 322 are slidable to adjust the distance between the first clamping portion 41 and the second clamping portion 42, and the user can adjust the distance between the first clamping portion 41 and the second clamping portion 42 according to a distance between the two ends of the hose clamp.

Specifically, in this embodiment, the first shank portion 11 and the second shank portion 12 are pivoted to a first pivot portion 61, the connecting member 21 and the first shank portion 11 are connected to a second pivot portion 62, the connecting member 21 and the slidable member 22 are connected to a third pivot portion 63, the first pivot portion 61 is arranged on one of two ends of the second shank portion 12 remote from the first clamping portion 41, when the first shank portion 11 and the second shank portion 12 swing toward each other, the second pivot portion 62 swings toward the second shank portion 12, and the third pivot portion 63 slides toward the second clamping portion 42 and slides away from the first pivot portion 61; therefore, through a swinging movement of the connecting member 21, the first and second shank portions 11, 12 swing relative to each other to actuate the first and second clamping portions 41, 42 to move linearly so as to clamp the two ends of the hose clamp 9 precisely.

Figure 7:
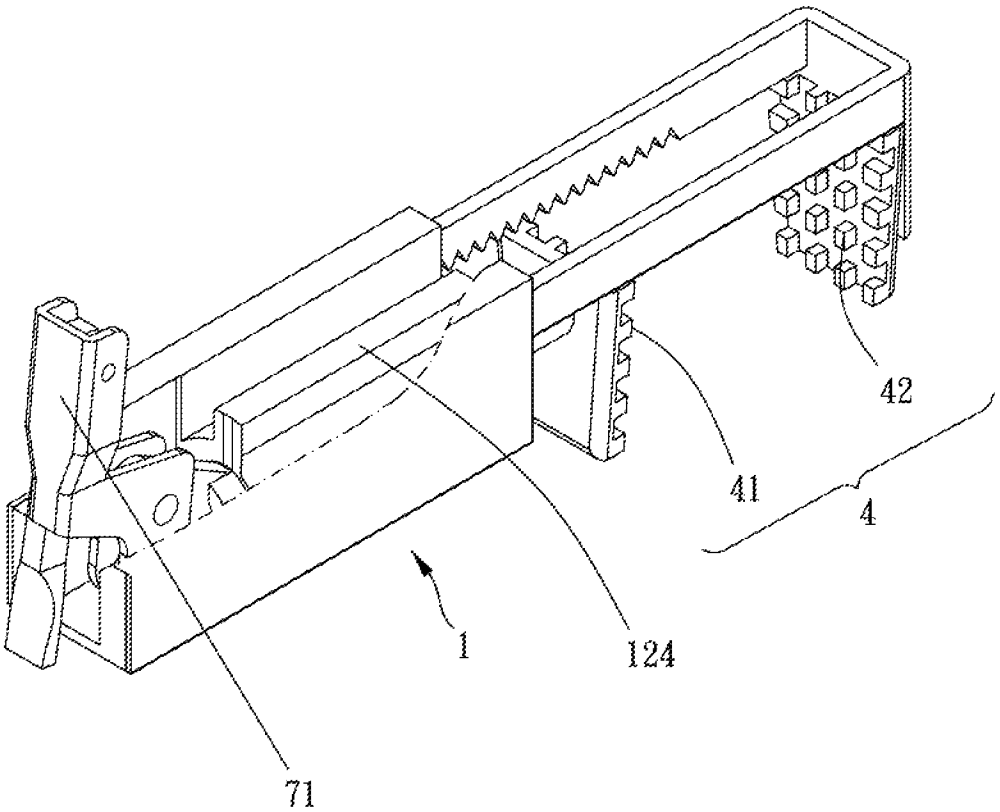
FIG. 7 is another stereogram of the first preferred embodiment of the present invention.

Preferably, the pliers for the hose clamp further has a toggling member 7, one of two ends of the first shank portion 11 which is remote from the first pivot portion 61 and one of two ends of the toggling member 7 are pivoted to a fourth pivot portion 64, the other of the two ends of the toggling member 7 is a free end, when the first shank portion 11 and the second shank portion 12 swing toward each other and are folded, the first shank portion 11 is z-shaped, the first pivot portion 61 and the fourth pivot portion 64 are respectively disposed on the two ends of the first shank portion 11, the second pivot portion 62 is disposed on a curved section of the first shank portion 11, a middle section 71 of the toggling member 7 which is located between the free end and the fourth pivot portion 64 abuts against a blocking flange 124 of the second shank portion 12 (as shown in FIGS. 5 to 7), and when the free end of the toggling member 7 is pressed and swings toward the second shank portion 12, the middle section 71 serves as a fulcrum of the toggling member 7 according to lever principle, the fourth pivot portion 64 swings away from the second shank portion 12. Through the first elastic member 5, the first shank portion 11 will swing automatically away from the second shank portion 12, so the user can control the first and second shank portion 11, 12 to open or close without changing the way of gripping.

Given the above, in the pliers for the hose clamp, the first and second shank portions swing relative to each other to actuate the first and second clamping portions to move linearly so as to clamp the two ends of the hose clamp precisely. In addition, when the user wants to adjust the initial distance between the first clamping portion and the second clamping portion, s/he only needs to toggle the abutting block away from the two arm portions to make the first toothed portion non-abut against the second toothed portion, then the two arm portions are slidable to adjust the initial distance between the first clamping portion and the second clamping portion, and the user can adjust the initial distance between the first clamping portion and the second clamping portion according to the distance between the two ends of the hose clamp so that the user does not have to conduct repeated hand actions.

While we have shown and described various embodiments in accordance with the present invention, it should be clear to those skilled in the art that further embodiments may be made without departing from the scope of the present invention.

What is claimed is:

1. A pliers for a hose clamp, including:

a pivoting assembly, including a first shank portion and a second shank portion which are pivotally assembled with each other;

a displacement assembly, assembled to the pivoting assembly, including a connecting member and a slidable member, the slidable member being slidable along a linear direction, the connecting member being pivotally disposed between the first shank portion and the slidable member;

an adjustment assembly, assembled to the pivoting assembly, including an abutting member and an adjusting member, the abutting member positioningly abutting against and toward the adjusting member normally, when the abutting member non-abuts against the adjusting member, the adjusting member is slidable parallel to the linear direction freely;

a clamping assembly, including a first clamping portion and a second clamping portion, the first clamping portion co-movably disposed on the slidable member, the second clamping portion being disposed on the adjusting member, the second clamping portion being located by one of two sides of the first clamping portion on the linear direction, the first clamping portion being located between the second clamping portion and the connecting member;

wherein when the first shank portion and the second shank portion swing toward each other, the connecting member is driven by the first shank portion to push the slidable member to move toward the second clamping portion, and the first clamping portion and the second clamping portion move toward each other; when the first shank portion and the second shank portion swing away from each other, the connecting member is driven by the first shank portion to pull the slidable member to move away from the second clamping portion, and the first clamping portion and second clamping portion move away from each other;

wherein the abutting member is retractably mounted on the second shank portion, and the abutting member is movable relative to the second shank portion in a direction toward the adjusting member to be positionably engage with the adjusting member; wherein the abutting member includes an abutting block and at least one second elastic member, the adjusting member is slidably arranged within the second shank portion, the second shank portion has a receiving groove, the abutting block and the at least one second elastic member are received in the receiving groove, the at least one second elastic member abuts against and between a wall of the receiving groove and the abutting block, the abutting block has a first toothed portion, and the adjusting member has a second toothed portion which abuts against the first toothed portion.

2. The pliers for the hose clamp of claim 1, further including a first elastic member, the second shank portion being a U-shaped board member, the first elastic member abutting against and between the second shank portion and the slidable member so that the slidable member normally moves away from the second clamping portion.

3. The pliers for the hose clamp of claim 1, wherein the adjusting member further includes two arm portions, the second clamping portion is connected to the two arm portions, two sides of the second shank portion have two L-shaped extension sections, the two L-shaped extension sections include two sliding grooves which are parallel to the linear direction, and the two arm portions are respectively slidably arranged in the two sliding grooves.

4. A pliers for a hose clamp, including:

a pivoting assembly, including a first shank portion and a second shank portion which are pivotally assembled with each other;

a displacement assembly, assembled to the pivoting assembly, including a connecting member and a slidable member, the slidable member being slidable along a linear direction, the connecting member being pivotally disposed between the first shank portion and the slidable member;

an adjustment assembly, assembled to the pivoting assembly, including an abutting member and an adjusting member, the abutting member positioningly abutting against and toward the adjusting member normally, when the abutting member non-abuts against the adjusting member, the adjusting member is slidable parallel to the linear direction freely;

a clamping assembly, including a first clamping portion and a second clamping portion, the first clamping portion co-movably disposed on the slidable member, the second clamping portion being disposed on the adjusting member, the second clamping portion being located by one of two sides of the first clamping portion on the linear direction, the first clamping portion being located between the second clamping portion and the connecting member;

wherein when the first shank portion and the second shank portion swing toward each other, the connecting member is driven by the first shank portion to push the slidable member to move toward the second clamping portion, and the first clamping portion and the second clamping portion move toward each other; when the first shank portion and the second shank portion swing away from each other, the connecting member is driven by the first shank portion to pull the slidable member to move away from the second clamping portion, and the first clamping portion and second clamping portion move away from each other;

wherein the first shank portion and the second shank portion are pivoted to a first pivot portion, the connecting member and the first shank portion are connected to a second pivot portion, the connecting member and the slidable member are connected to a third pivot portion, the first pivot portion is arranged on one of two ends of the second shank portion remote from the first clamping portion, when the first shank portion and the second shank portion swing toward each other, the second pivot portion swings toward the second shank portion, and the third pivot portion moves toward the second clamping portion and moves away from the first pivot portion.

5. The pliers for the hose clamp of claim 4, further including a toggling member, wherein one of two ends of the first shank portion which is remote from the first pivot portion and one of two ends of the toggling member are pivoted to a fourth pivot portion, the other of the two ends of the toggling member is a free end, when the first shank portion and the second shank portion swing toward each other and are folded, a middle section of the toggling member which is located between the free end and the fourth pivot portion abuts against a blocking flange of the second shank portion, and when the free end of the toggling member is pressed and swings toward the second shank portion, the fourth pivot portion swings away from the second shank portion.

6. The pliers for the hose clamp of claim 5, wherein the first shank portion is z-shaped, the first pivot portion and the fourth pivot portion are respectively disposed on the two ends of the first shank portion, and the second pivot portion is disposed on a curved section of the first shank portion.

7. The pliers for the hose clamp of claim 1, wherein one of the two sides of the first clamping portion and one of two sides of the second clamping portion which face each other respectively have a plurality of protrusive blocks which are arranged spacingly, and the protrusive blocks are for abutting against two ends of a hose clamp which is clamped by the first and second clamping portions.

8. The pliers for the hose clamp of claim 6, further including a first elastic member, the second shank portion being a U-shaped board member, the first elastic member abutting against and between the second shank portion and the slidable member so that the slidable member normally moves away from the second clamping portion; the abutting member including an abutting block and at least one second elastic member, the adjusting member being slidably arranged within the second shank portion, the second shank portion having a receiving groove, the abutting block and the at least one second elastic member being received in the receiving groove, the at least one second elastic member abutting against and between a wall of the receiving groove and the abutting block, the abutting block having a first toothed portion, the adjusting member having a second toothed portion which abuts against the first toothed portion; the adjusting member further including two arm portions, the second clamping portion being connected to the two arm portions, two sides of the second shank portion having two L-shaped extension sections, the two L-shaped extension sections including two sliding grooves which are parallel to the linear direction, the two arm portions being respectively slidably arranged in the two sliding grooves; one of the two sides of the first clamping portion and one of two sides of the second clamping portion which face each other respectively having a plurality of protrusive blocks which are arranged spacingly, the protrusive blocks being for abutting against two ends of a hose clamp which is clamped by the first and second clamping portions.

* * * * *